US005105484A

United States Patent [19]

Forsythe

[11] Patent Number: 5,105,484

[45] Date of Patent: Apr. 21, 1992

[54] BACK SCRUBBER DEVICE

[76] Inventor: Royden J. Forsythe, 7815 Elm St., Harvard, Ill. 60033

[21] Appl. No.: 594,075

[22] Filed: Oct. 9, 1990

[51] Int. Cl.[5] ..... A47K 7/02

[52] U.S. Cl. ..... 4/606; 4/559

[58] Field of Search ..... 4/559, 606; 15/160, 15/244.1

[56] References Cited

U.S. PATENT DOCUMENTS

| | | | |
|---|---|---|---|
| 350,490 | 10/1886 | James | 4/606 |
| 1,297,980 | 3/1919 | Weinberger | 4/559 |
| 1,488,076 | 3/1924 | Tebo | 4/606 |
| 1,587,353 | 6/1926 | Pfeufer | 4/606 |
| 1,999,799 | 4/1935 | Beck et al. | 4/559 |
| 2,187,977 | 1/1940 | Large | 4/559 |
| 3,078,484 | 2/1963 | Briggs | 4/606 |
| 3,085,269 | 4/1963 | Greer | 4/606 X |
| 3,109,177 | 11/1963 | Grafmyer | 4/606 |
| 3,699,602 | 10/1972 | Cameron | 4/606 X |
| 3,862,459 | 1/1975 | Brunette | 4/606 X |
| 4,360,159 | 11/1982 | Haynes | 4/605 |

FOREIGN PATENT DOCUMENTS

| | | | |
|---|---|---|---|
| 2433140 | 1/1975 | Fed. Rep. of Germany | 15/160 |
| 0712391 | 7/1931 | France | 15/160 |
| 0239128 | 9/1925 | United Kingdom | 4/606 |
| 253823 | 6/1926 | United Kingdom | 15/160 |
| 408582 | 11/1928 | United Kingdom | 4/606 |

*Primary Examiner*—William A. Cuchlinksi, Jr.
*Assistant Examiner*—John L. Beres
*Attorney, Agent, or Firm*—Frank R. Thienpont

[57] ABSTRACT

A back scrubber device adapted to be mounted in a shower stall or on the wall of a bathtub including a substantially U-shaped back scrubber bar having a central portion and first and second spaced leg portions, the central portion being connectible to a wall support mounting bracket and the spaced portions of said bar being sufficiently spaced to fit a person therebetween, scrubber means attached at one end of one of the spaced leg portions and the other spaced leg portion providing a handle means, the scrubber being movable in an up and down motion to scrub a person's back through movement of the handle means by the person standing between the two spaced leg portions of the back scrubber bar.

3 Claims, 4 Drawing Sheets

BACK SCRUBBER DEVICE

This invention relates to a back scrubber device which may be mounted on the wall of a shower stall or bathtub wall.

SUMMARY OF THE INVENTION

A principal object of this invention is to provide a simple and effective back scrubbing device which can easily be installed in and used with a shower stall or bathtub.

Another object is to provide a back scrubber device which in its installed position in a shower stall or bathtub can be easily manipulated by the user without going through the difficult contortions sometimes associated with washing the back.

Another object is to provide a back scrubber device which is pivotally mounted in a shower stall or bathtub so that a person using the shower stall or bathtub can move the scrubber means up and down in contact with the person's back by manipulating the scrubber device handle portion disposed in front of the person.

Additional objects and features of the invention will become more apparent from the following description and accompanying drawings.

DESCRIPTION OF PREFERRED EMBODIMENTS

Figure 1:
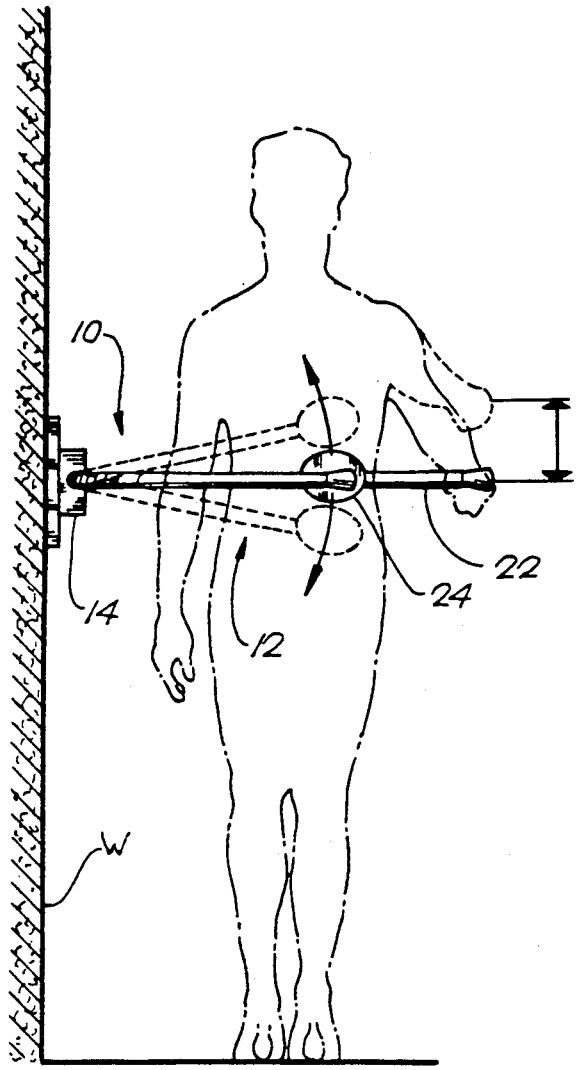
FIG. 1 is a side view in elevation showing a back scrubber device pivotally mounted to a wall and in different vertical positions in relation to a person operating the device.

Referring now to the drawings wherein like reference characters refer to like parts, the back scrubber device 10 is shown in FIG. 1 pivotally mounted on a wall supporting structure W. The back scrubber device 10 includes a substantially U-shaped scrubber bar 12 and a mounting bracket 14 which is attached to a vertical support member 16, the latter in turn being secured to the wall structure W. The back scrubber device 10 may be adjusted to different vertical positions by selectively moving the mounting bracket up or down on the support member 16.

Figure 2:
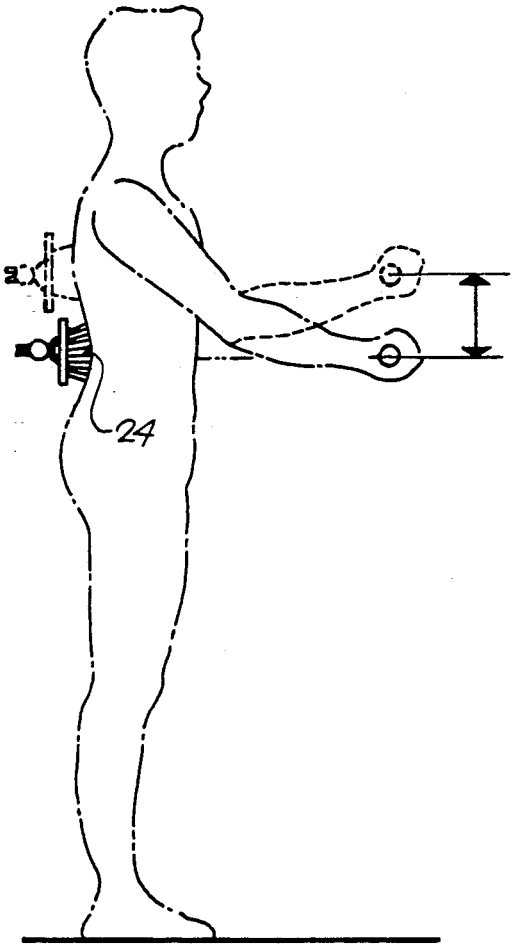
FIG. 2 is a front view in elevation showing the back scrubber device of FIG. 1 in different vertical positions.
Figure 3:
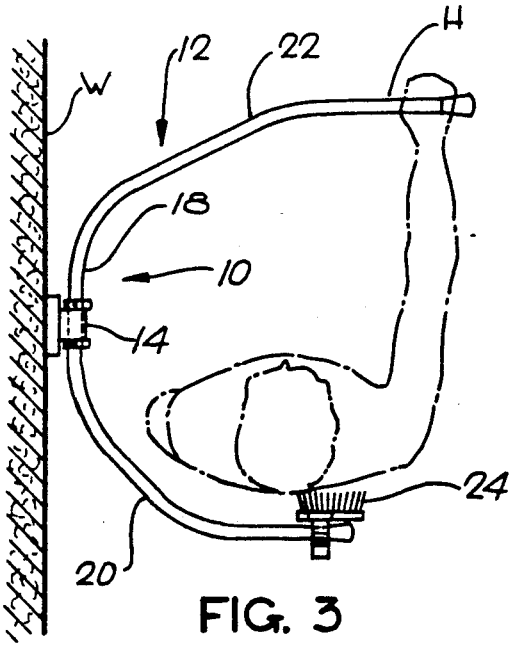
FIG. 3 is a top plan view showing the substantially U-shaped back scrubber device in relation to a person manipulating the device.

The substantially U-shaped scrubber bar 12 may be a tubular metal structure. It includes a central portion 18 and first and second leg portions 20 and 22. The central portion 18 is designed to be pivotally connected with the mounting bracket 14. The first leg portion 20 is adapted to have a scrubbing device replaceably attached thereto. Such a scrubbing device may be a brush 24 or other cleaning device such as a sponge, for example. An ordinary back scratching device could also be attached. The other leg or free end portion 22 is adapted to function as a handle means H as shown in FIGS. 1, 2 and 3.

Figure 4:
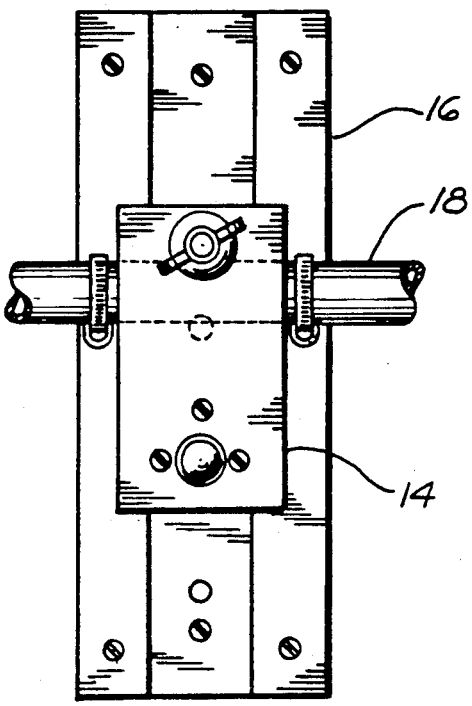
FIG. 4 is a front view in elevation of a mounting bracket for supporting the back scrubber bar and vertically positioning the back scrubber device of FIG. 1 on a vertically extending support member.
Figure 6:
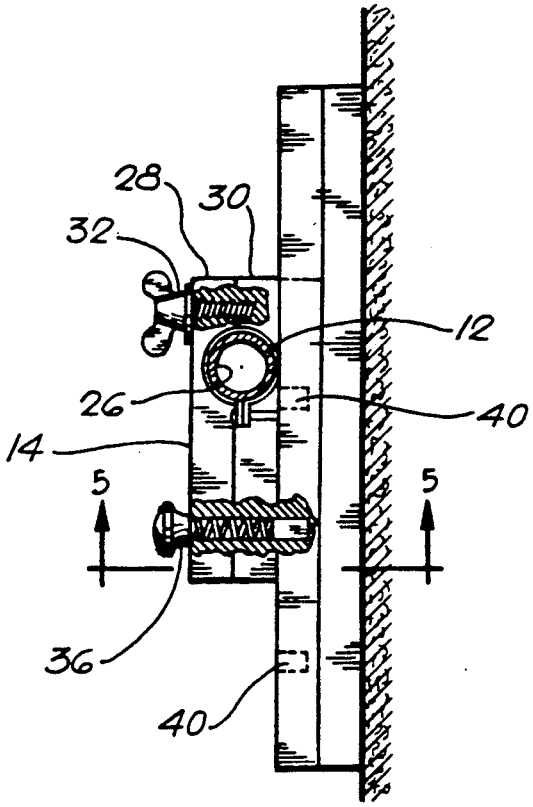
FIG. 6 is a side view in elevation partially in section of the back scrubber mounting bracket of FIG. 5 positioned on the vertically extending support member.
Figure 5:
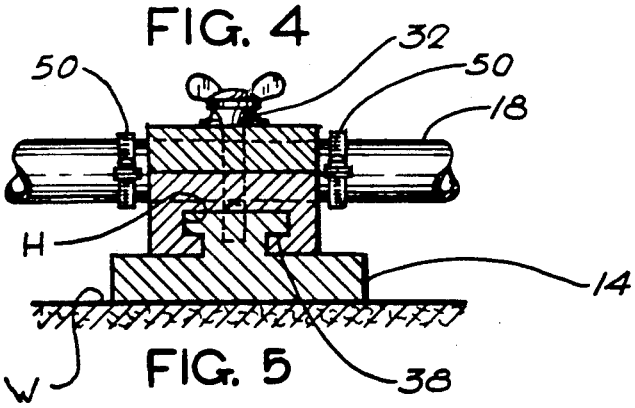
FIG. 5 is a bottom plan view partially in section taken at line 5—5 of FIG. 6 of the back scrubber device mounting bracket mounted on the vertically extending support member.

The mounting bracket 14 may be of a generally rectangular construction as shown in FIGS. 4, 5 and 6. It is constructed with a transverse annular opening or bore 26 for receiving the central portion 18 of the scrubber bar 12 therein, the opening 26 acting as a bearing for the scrubber bar as the latter is rotated during operation of the back scrubber device. The bracket 14 may be made of two platelike members 28 and 30 which define the opening 26 and which in the assembly with the scrubber bar are held together by suitable means such as a threaded bolt 32. A groove or T-slot 34 may be formed in the bracket 14 to engage a mating portion of the support member 16. A spring-loaded locking pin 36 extends through the mounting bracket 14 to selectively engage one of a plurality of openings in the vertical support member as best seen in FIG. 6 for vertical height adjustment of the mounting bracket and associated scrubber bar. As is apparent from the assembly of the scrubber bar 12 and mounting bracket 14 shown in FIGS. 4, 5 and 6, the scrubber bar is mounted for a pivotal movement in the mounting bracket 14 to give an up and down arcuate movement to the brush 24 as seen, for example, in FIG. 1.

The vertical support member 16 may be secured to the wall structure W by any suitable means. The support member 16 may be formed with a tongue portion 38 for engaging the groove or T-slot 34 formed in the mounting bracket 14 so that slidable engagement may be effected between the mounting bracket 14 and the support member 16 for height adjustment of the mounted bracket. Openings 40 as previously indicated may be formed in the support member 16 to receive a locking pin 36 as the vertical position of the mounting bracket 14 is selectively changed on the support member 16. Abutment means in the nature of straps 50 may be attached to the central portion 18 of the scrubber bar 12 to prevent lateral movement of the scrubber bar relative to the mounting bracket 14. Both the mounting bracket 14 and vertical support 16 may be made of metal or plastic.

Figure 7:
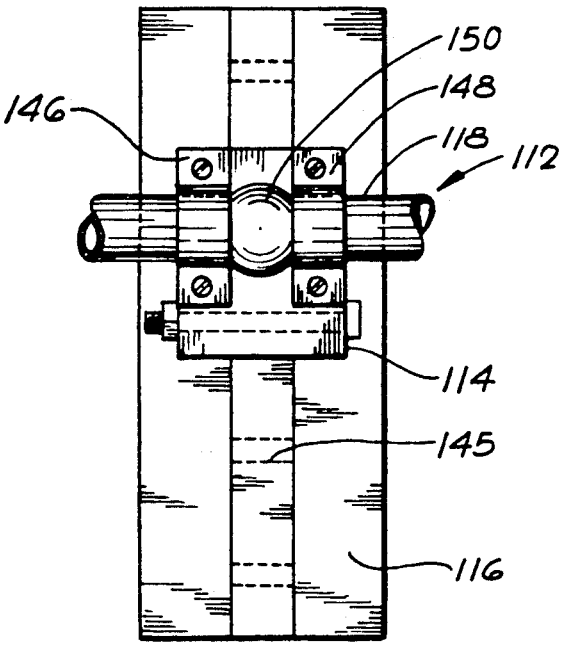
FIG. 7 is a front view in elevation of a second embodiment of a mounting bracket for supporting the back scrubber bar and for vertically positioning the back scrubber device on a vertically extending support member.
Figure 9:
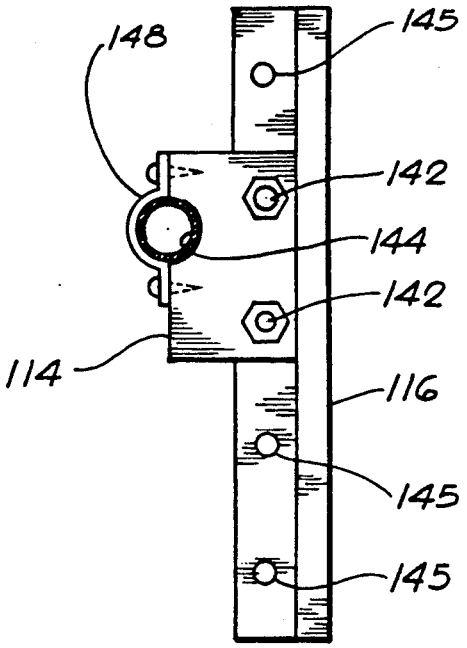
FIG. 9 is a side view in elevation of the back scrubber mounting bracket of FIG. 8 positioned on the vertical support member.
Figure 8:
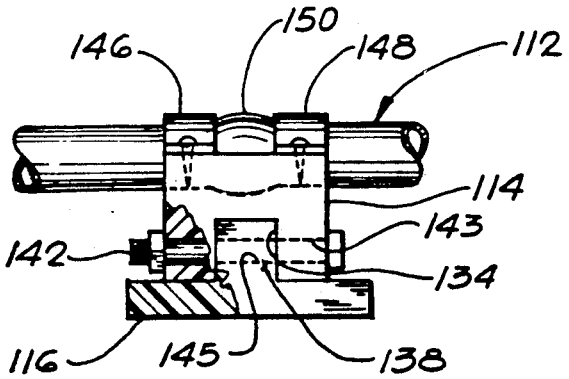
FIG. 8 is a bottom plan view of the back scrubber device mounting bracket support of FIG. 7 mounted on a vertical support member.

A second embodiment of the back scrubber device is shown in FIGS. 7, 8 and 9. Here again a back scrubber bar 112 is rotatably supported in a mounting bracket 114 which may be selectively positioned on a vertical support member 116. In this embodiment the mounting bracket is formed with a slot 134 which is adapted to engage a rail-like tongue portion 138 on the vertical support member 116. The mounting bracket 114 may be selectively positioned on the vertical support member 116 by means of one or more bolts 142 which extend through openings 143 in the mounting bracket 114 and holes 145 in member 16 to secure the mounting bracket 114 to the vertical support member 116. The mounting bracket 114 is formed with a partial bore or a semi-circular groove 144 which provides part of the bearing surface for supporting therein the central portion 118 of the scrubber bar. Securing straps 146 and 148 also formed with a semi-circular bearing surface are attached to the mounting bracket 114 and overlie the central portion of the scrubber bar to secure the scrubber bar in the mounting bracket 114 and to allow for the pivotal movement of the scrubber bar in the mounting bracket. The scrubber bar has associated therewith an enlarged abutment 150 which lies between the strap members 146 and 148 thus preventing lateral movement of the scrubber bar in its secured position.

From the above description of the two embodiments the operation of the scrubber device is apparent. As best seen in FIGS. 1, 2 and 3, a person stands between the leg portions 20 and 22 of the scrubber bar and manipulates the handle to pivotally move the scrubber bar in the mounting bracket 14 or 114 to effect a slightly arcuate up and down movement of the scrubber device attached at the end of leg portion 20. It will be apparent that as the person moves slightly from time to time, all parts of the back may be completely scrubbed.

Figure 10:
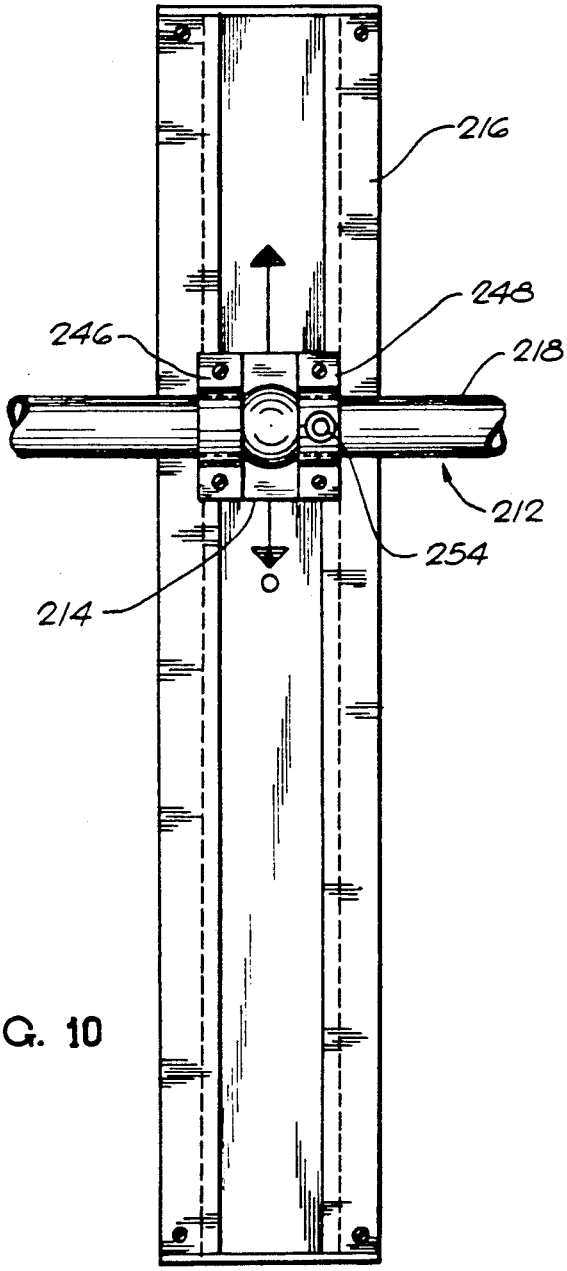
FIG. 10 is a front view in elevation of a third embodiment of the invention showing a back scrubber device slidably mounted for up and down movement on a vertically extending slide member.
Figure 12:
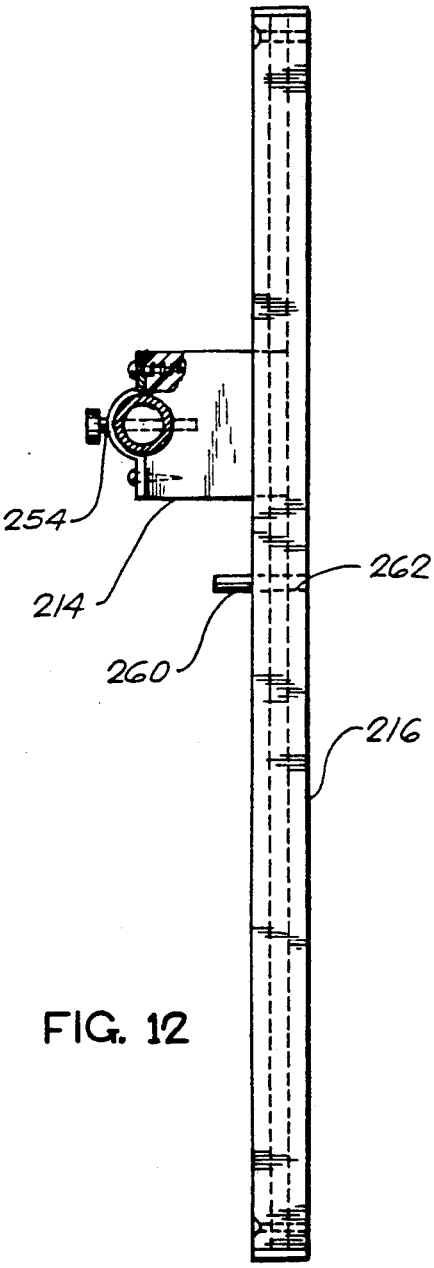
FIG. 12 is a side view in elevation of the back scrubber device of FIG. 10.
Figure 11:
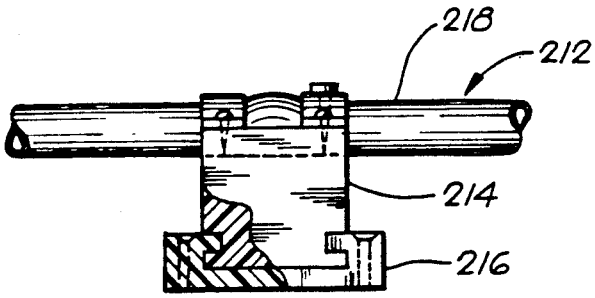
FIG. 11 is a bottom plan view of the back scrubber device of FIG. 10 slidably mounted on the slide member.

FIGS. 10, 11 and 12 illustrate still another embodiments of the back scrubber device. This scrubber device is somewhat similar to that shown in FIGS. 7, 8 and 9 insofar as the connection between the scrubber bar and the mounting bracket is concerned. However, the overall device is designed to allow reciprocal up and down movement of the mounting bracket 214 with respect to the vertical support member 216 during the actual scrubbing operation. In this particular embodiment the scrubber bar and its attached brush does not pivot in the mounting bracket 214 but stays in the same plane. During operation of the back scrubber device the scrubber bar 212 is secured in a horizontal position by means of a securing pin 254 which extends through one of the brackets or straps 246 or 248 and through an aligned opening in the central portion 218 of the scrubber bar 212. The movement of the scrubber bar is accomplished by the reciprocating movement of the mounting bracket 214 in the vertical support member 214. A variety of means may be provided to secure the mounting bracket at a selected position on the vertical support member when the scrubber device is not in use. One such means is a removable pin 260 which may be inserted into a corresponding opening 262 in the support member 216, permitting the mounting bracket 214 to rest thereon when the device is not in operation.

It will be apparent from the above that I have advantageously provided a unique, easily usable back scrubber device. It is especially useful for someone who may have difficulty twisting and turning due to arthritic complications, for example, or other physical impairments.

While preferred embodiments of the invention have been disclosed herein, it will be appreciated that these are shown by way of example only, and the invention is not to be limited thereto as other variations will be apparent to those skilled in the art, and the invention is to be given its fullest interpretation within the terms of the following claims:

What is claimed:

1. A back scrubber device for use in association with a wall of a shower stall or wall surrounding a bathtub comprising:

a substantially U-shaped back scrubber bar having a central portion and first and second spaced leg portions;

scrubber means attached to said first leg portion;

handle means associated with said second leg portion;

said first and second leg portions being spaced apart a predetermined distance sufficient to allow a person to position himself easily therebetween;

mounting bracket means for supporting said back scrubber bar;

means for attaching said mounting bracket means to a vertical support member adapted to be attached to the wall of the shower stall or wall surrounding the bathtub;

lock pin means for securing said mounting bracket means to the vertical support member; and horizontally extending pivot means in said mounting bracket means for pivotally supporting said scrubber bar whereby said scrubber bar may be pivoted about said pivot means in a vertical plane by manipulation of said handle means.

2. The back scrubber device of claim 1 including vertical positioning means for selectively positioning said mounting bracket means on a vertical support member.

3. A back scrubber device for use in association with a wall of a shower stall or wall surrounding a bathtub comprising:

a substantially U-shaped scrubber bar having a central portion and first and second spaced leg portions;

scrubber means attached to said first leg portion;

handle means associated with said second leg portion;

said first and second leg portions being spaced apart a predetermined distance sufficient to allow a person to position himself easily therebetween;

mounting bracket means for supporting said back scrubber bar;

means for attaching said mounting bracket means to a vertical support member adapted to be attached to the wall of the shower stall or wall surrounding the bathtub; horizontally extending pivot means in said mounting bracket means for pivotally supporting said scrubber bar whereby said scrubber bar may be pivoted about said pivot means in a vertical plane by manipulation of said handle means; and means associated with said central portion of said scrubber bar for preventing undesirable lateral movement of the scrubber bar relative to said mounting bracket, means, said means for preventing undesirable lateral movement of the scrubber bar comprising enlarged abutment means associated with said central portion of said scrubber bar.

* * * * *